US006427486B1

(12) United States Patent
Yellen

(10) Patent No.: US 6,427,486 B1
(45) Date of Patent: Aug. 6, 2002

(54) PINLESS ARTICULATED BAND

(76) Inventor: Benjamin B. Yellen, 2509 Virginia La., Northbrook, IL (US) 60062

( * ) Notice: Subject to any disclaimer, the term of this patent is extended or adjusted under 35 U.S.C. 154(b) by 0 days.

(21) Appl. No.: 09/624,414

(22) Filed: Jul. 24, 2000

Related U.S. Application Data

(63) Continuation-in-part of application No. 29/121,893, filed on Apr. 17, 2000.

(51) Int. Cl.[7] ..... A44C 5/00
(52) U.S. Cl. ..... 63/3; 63/3.1; 63/39; 63/900
(58) Field of Search ..... 63/3, 3.1, 33, 38, 63/39, 900; 24/303; 446/132, 137; 273/155, 156, 157 R

(56) References Cited

U.S. PATENT DOCUMENTS

| | | | | |
|---|---|---|---|---|
| 2,570,625 | A | * 10/1951 | Zimmerman et al. | |
| 2,615,227 | A | * 10/1952 | Hornick | |
| 3,263,444 | A | * 8/1966 | Di Croce | |
| 3,885,383 | A | * 5/1975 | Tanaka | 59/79 R |
| 4,238,905 | A | * 12/1980 | MacGraw, II | 46/25 |
| 4,917,644 | A | * 4/1990 | Sunshine | 446/26 |
| 4,941,236 | A | * 7/1990 | Sherman et al. | 24/303 |
| 5,050,276 | A | * 9/1991 | Pemberton | 24/303 |
| 5,195,335 | A | * 3/1993 | Hart | 63/2 |
| 5,324,037 | A | * 6/1994 | Greeson | 273/155 |
| 5,347,253 | A | * 9/1994 | Ogikubo | 335/302 |
| 5,535,603 | A | * 7/1996 | Hayakawa | 63/3 |
| 5,572,887 | A | * 11/1996 | Gewelli | 63/3 |

FOREIGN PATENT DOCUMENTS

| | | |
|---|---|---|
| FR | 2221096 | * 11/1974 |
| GB | 2287884 | * 4/1995 |
| GB | 2285222 | * 5/1995 |
| JP | 11-75916 | * 3/1999 |
| JP | 11-103915 | * 4/1999 |
| JP | 2000-83714 | * 3/2000 |

* cited by examiner

*Primary Examiner*—Anthony Knight
*Assistant Examiner*—Alison Pickard
(74) *Attorney, Agent, or Firm*—Michael G. Berkman

(57) ABSTRACT

An articulated band of the invention is formed of a lineal array of metallic elements arranged in a repeating pattern. The elements are separably bonded to one another through magnetic forces acting therebetween. The band is characterized in that it is free of pins and other mechanical structural agents for interconnecting the band elements to one another. The configuration of the elements themselves is such that each has at least two surfaces, and such that these surfaces include one which is curved or arcuate. In a preferred embodiment of the invention, the elements include cylinders and discs which are of the same diameters. The cylinders and discs are so arranged that their axes are parallel to one another. In a closed loop configuration, the band exhibits aesthetic design features and finds use as a bracelet.

12 Claims, 2 Drawing Sheets

PINLESS ARTICULATED BAND

This is a Continuation-in-part of application Ser. No. 29/121,893 filed Apr. 17, 2000.

FIELD AND BACKGROUND OF THE INVENTION

The present invention relates to an articulated metal band. More particularly, the invention is directed to an articulated band characterized in that it is devoid of pins and other mechanical devices for physically connecting adjacent segmental sectors or elements of the band to one another. A critical feature of the band of the invention is that it is formed of discrete metal bodies which are magnetically charged. Arrangeable, as desired, in various physical configurations, the charged metallic component elements of the band bond or adhere positively and firmly to one another, magnetically, to provide any of a selectable series of distinct and varied physical configurations or designs.

In one preferred embodiment of the invention, the articulated band assumes the physical form of a closed-loop bracelet. In each of at least two different and distinct designs or physical arrangement of component parts of embodiments of the present invention, the loop structure which constitutes the bracelet defines an uninterrupted, continuous, repetitive and endless pattern.

None of the prior art "magnetic" bracelets is believed to have the versatility of the bracelets of the present invention. None is believed to include a capability of assuming separate and distinct design configurations by a simple and rapid rearrangement of the family of magnetic physical elements employed.

SUMMARY OF THE INVENTION

The present invention provides structural magnetically charged metallic elements or bodies for bonding firmly to one another in various selectable patterns or designs to form an articulated band.

It is an important feature of the band of the invention that the component parts are held firmly together as a stable "unitary" structure without the use of, and without the need for pins, wires, or cording, or fasteners of any type.

A principal object of the present invention is to provide magnetically charged discrete metallic bodies of particular physical configurations and to arrange the bodies for bonding interengagement with one another to form a lineal array, thereby to establish an articulated band. The bodies are composed of magnetic material exclusive of decorative and protective coatings.

A related object of the present invention is to provide an articulated band of magnetically charged discrete metallic bodies where a majority of the bodies have at least one curved surface, a longitudinal axis and opposed magnetic poles.

It is an important feature of the present invention that there is provided a lineal array of magnetically charged metallic bodies bonded to one another to form an articulated band which can be bent upon itself to form a closed loop, the loop defining an uninterrupted, repetitive and endless pattern.

A related feature of the articulated, pinless, metallic band of the invention is that it is conveniently converted to a closed loop finding utility as a decorative bracelet.

In a preferred embodiment of the invention the magnetic bodies include cylinders magnetized in a direction at right angles to the longitudinal axis if each cylinder.

In addition to cylrindrical components, a preferred embodiment of the invention includes discs, these being magnetized in a radial direction thereof.

It is a feature of one embodiment of the invention that the bodies of the band include cylinders and discs which have substantially corresponding diameters.

In one preferred arrangement of the cylinders and the discs of the articulated band of the invention, there are included cylinders and discs arranged so that the end faces of the discs are disposed at end faces of the cylinders, coaxially therewith and in contacting abutment thereagainst to bond magnetically therewith.

In another embodiment of the invention including discs and cylinders, the discs are disposed adjacent but offset axially from centers of end faces of the cylinders and in substantially axial correspondence with lines defined by abutting tangential lineal contact zones of contiguous cylinders of the band with one another.

In a principal embodiment of the invention the articulated band is curved upon itself with opposite ends joined to one another to form an endless looped structure.

A related feature of the invention characterizing the articulated band is that the looped structure defines an uninterrupted, continuous, repetitive and endless pattern.

It is a principal, important and critical feature of the articulated band of the invention that it is devoid of pins and other mechanical devices or elements for physically connecting adjacent segmental sectors of the band to one another.

The articulated band of the invention is characterized by a high degree of flexibility in a plane defined by a lineal array of cylindrical bodies and discs bonded thereto.

In one preferred embodiment of the articulated band of the invention, connector structures disposed at opposed ends of the band and bonded magnetically thereto serve releasably to couple the ends of the band to one another to form a closed loop structure.

It is an important functional feature of the articulated band of the invention that each of the component physical elements which define the band structurally has at least two surfaces, and that these surfaces include at least one which is curved or arcuate.

It is an exceedingly important design feature of the articulated band of the invention that in a closed loop configuration the band exhibits aesthetic design features and finds use as a decorative bracelet.

In one preferred embodiment of the invention including cylinders and discs, the cylinders have a diameter of about ¼ th inch and a height of about ¼ the inch, and the discs have a thickness of about 1/12 th inch and a diameter of about ¼ th inch.

It is a related feature of the invention that the dimensions of the component parts are not critical. They may vary, within practical limits.

Other and further objects, features and advantages of the invention will become apparent from the following detailed description considered in conjunction with the drawings.

DETAILED DESCRIPTION OF ILLUSTRATED EMBODIMENTS

In accordance with the present invention, the aims and objects are achieved by providing an articulated band devoid of pins and other mechanical devices for physically connecting adjacent segmental segments, sectors, or elements to one another. Critical is the fact that the component elements of the band constitute discrete metal bodies or elements each of which is magnetically charged. In preferred embodiments of the invention the component elements of the articulated band are cylinders and discs. The component metal elements bond or adhere firmly to one another, magnetically, to provide any of a selectable series of distinct and varied physical configurations or aesthetic representations or designs. In one preferred embodiment of the invention, the band constitutes a closed-loop bracelet characterized in that it defines a continuous, uninterrupted, repetitive and endless pattern.

Figure 1:
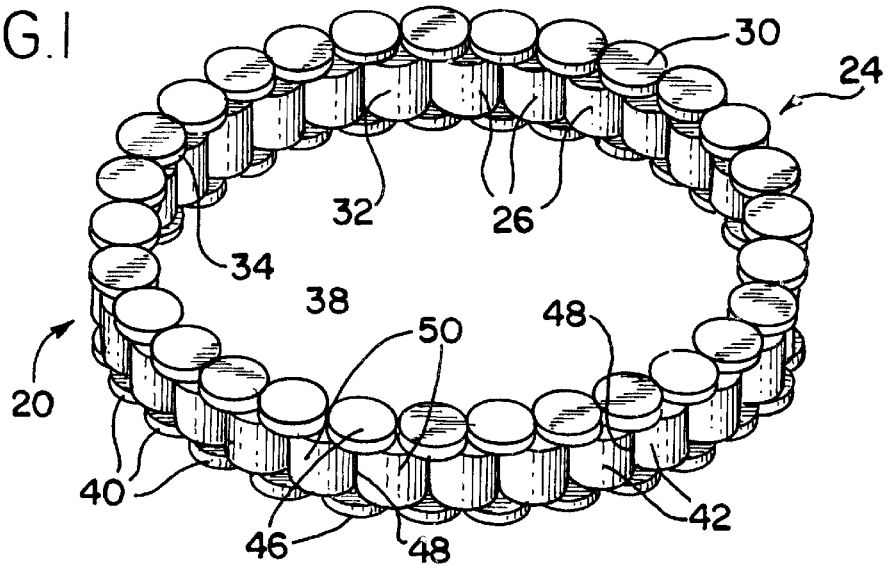
FIG. 1 is a perspective view of one embodiment of a magnetic articulated pinless band of the invention in the form of a closed loop and defining an uninterrupted, repetitive and endless pattern.

Referring now to the drawings, for purposes of disclosure and not in any limiting sense, a preferred embodiment of the invention is shown in FIG. 1 as comprising an articulated metal band 20. The band 20 is devoid of hooks, pins, or other fasteners, and is in the form or configuration of a closed, endless loop 24. The loop 24 defines a repetitive and uninterrupted continuous pattern. Referring further to FIG. 1, the loop 24 of the band 20 is structured of metal components or elements which include cylinders 26 and discs 30, each magnetically charged. That is, the cylinders are magnetized in a direction at right angles to the longitudinal axes thereof, and the discs 30 are magnetized in a radial direction thereof.

In the embodiment of the invention shown in FIG. 1, the cylinders 26 and the discs 30 have the same diametric dimension, measuring about ¼ th of an inch. The cylinders 26 have an axial height 32 of about ¼ th inch, and the discs 30 have a height or thickness 34 of about 1/12 th inch.

Figure 8:
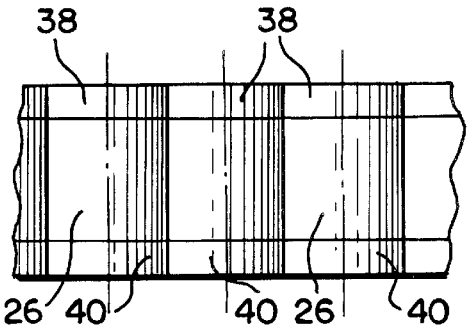
FIG. 8 is an enlarged fragmentary elevational view of an embodiment of the magnetic articulated band of the invention in which the cylinder and the overlying disc components of the band are arranged coaxially.

As shown in FIG. 1, the cylindrical elements 26 define an essentially coplanar array, and are in contact, each cylinder 26 with the next, tangentially, thus completing the uninterrupted circle or closed loop 24. The discs 30 are arranged in two spaced layers separated by the axial body expanse of the cylindrical elements 26. That is, the discs 30 include an "upper" layer 38 and a "lower" layer 40, with the cylinders 26 sandwiched therebetween (FIGS. 6 and 8).

Figure 6:
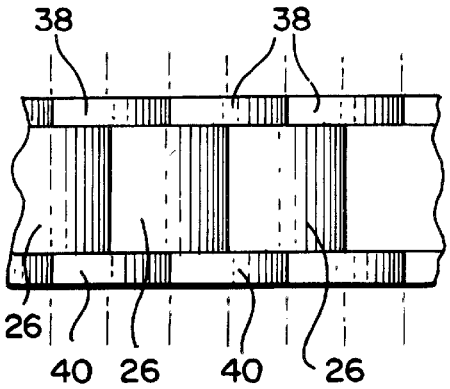
FIG. 6 is an enlarged, fragmentary elevational view of a sector of the band shown in FIG. 1, with the cylinder and disc elements arranged in a staggered mode.
Figure 7:
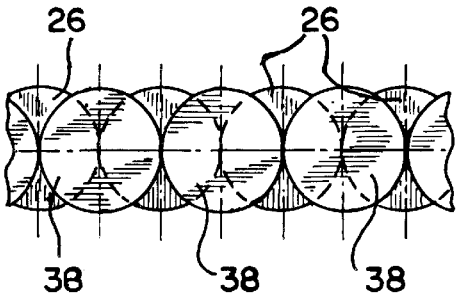
FIG. 7 is a top view of the arrangement of cylinder and disc elements of the band of the invention shown in FIGS. 1 and 6.

In the embodiment of the invention shown in FIG. 1 and FIGS. 6 and 7, the discs 30 are shown positioned or placed so that each overlies and bridges a pair 42 of the cylindrical elements 26, which elements 26 contact one another tangentially. Accordingly, the discs 30 also define a lineal, continuous, tangentially-abutting array. As shown, the discs 38 constituting the upper layer, and the discs 40 constituting the lower layer of the band 20 are so disposed or arranged as to form coaxial spaced pairs 46 separated by the vertical or axial expanse of the interposed cylinders 26. . The axis of each such pair 46 is correlated with or identifiable with a line of tangency 48 of each respective contacting pair 50 of the cylinders 26. That is, the discs 30 are stepped or displaced arcuately (or annularly) with respect to the sandwiched cylinder elements 26 (FIGS. 1 and 2 and 6 and 7). The extent of this displacement also corresponds to a radius dimension of the discs 30 or of the cylinders 26.

It will be understood that the loop 24 defining the band 20 may be opened at any selectable juncture of contacting discs 30 or cylinders 26 by exerting a separating force manually. The resulting opened loop 24 may then be closed, for example, about the wrist of an intended wearer, so that the band 20 may be worn as a bracelet. Closure of the temporarily "severed" loop is effective to re-establish, without impairment, the original strong, but temporarily interrupted, magnetic bond forces acting between the band components.

Figure 2:
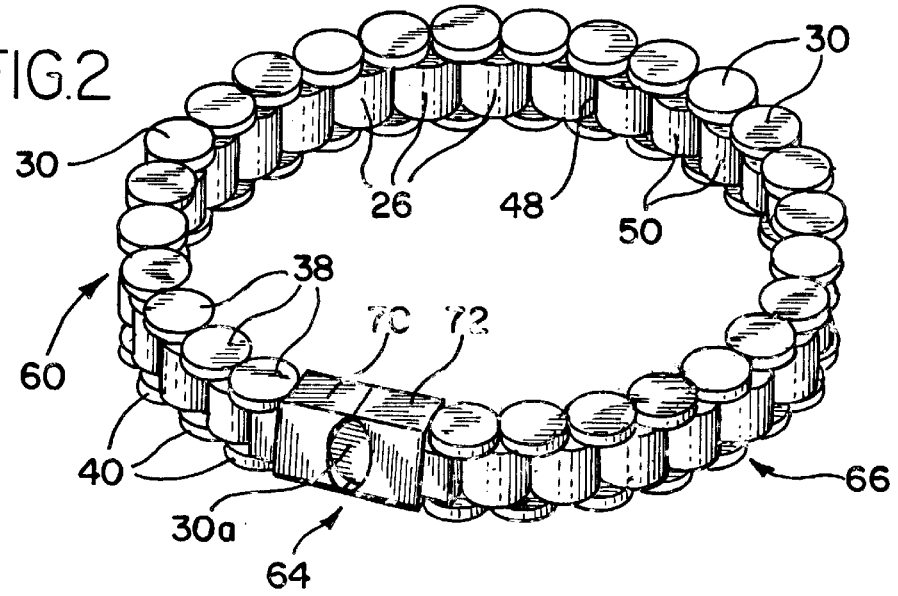
FIG. 2 is a perspective view of a band corresponding to the band of FIG. 1 but with a magnetic connector interposed in the band as a releasable coupler or closure.

Referring now to FIG. 2, there is shown an articulated band 60 which is in all material respects the same as the band 20 of FIG. 1 except that it includes a connector or fastener 64. The latter serves as a functional "insert" and constitutes a convenient mechanism by which the loop 66 formed by the band 60 is closed, and by which the band 60 may be conveniently re-opened, and re-closed, repeatedly.

Figure 3:
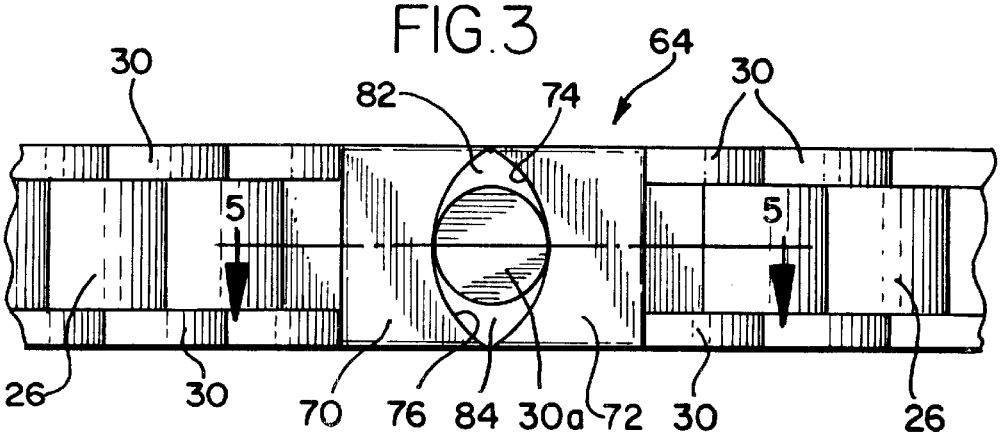
FIG. 3 is an enlarged fragmentary elevational view of the band of FIG. 2 showing the releasable coupler in a closed position.
Figure 4:
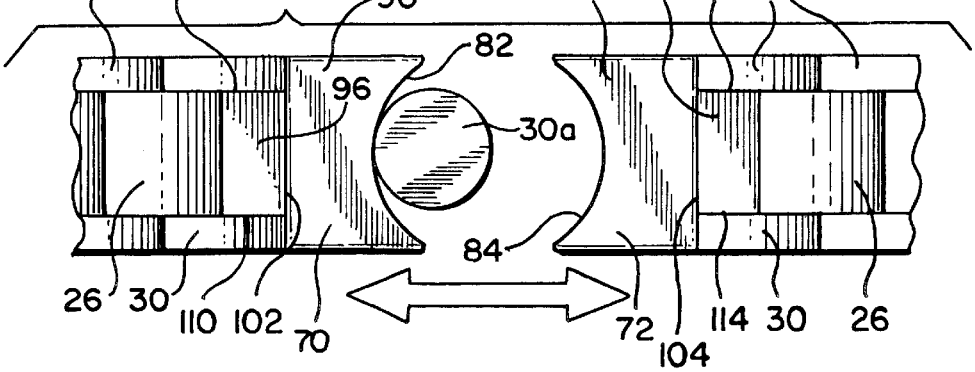
FIG. 4 is a view similar to that shown in FIG. 3 but with the band coupler in an open disposition.
Figure 5:
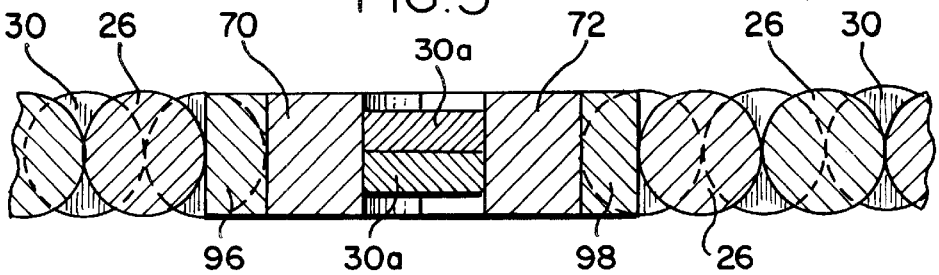
FIG. 5 is a cross-sectional view taken substantially on the lines 5—5 of FIG. 3.

As shown in FIGS. 3, 4 and 5, the connector 64 is bilaterally symmetrical. It includes a pair of block-like principal body portions 70 and 72 facing one another (FIG. 4). The height dimension of the block-like body portions 70 and 72 of the connector 64 corresponds to the combined, overall axial height of the cylinder element 36 plus the combined thicknesses of the lower and upper discs 30 (FIGS. 3 and 4). The body components 70 and 72 of the connector 64 are formed with inwardly-directed, outwardly-opening, curved walls 74 and 76 defining outwardly-opening recesses 82 and discs 38 constituting the upper layer, and the discs 40 constituting the lower layer of the band 20 are so disposed or arranged as to form coaxial spaced pairs 46 separated by the vertical or axial expanse of the interposed cylinders 26. . The axis of each such pair 46 is correlated with or identifiable with a line of tangency 48 of each respective contacting pair 50 of the cylinders 26. That is, the discs 30 are stepped or displaced arcuately (or annularly) with respect to the sandwiched cylinder elements 26 (FIGS. 1 and 2 and 6 and 7). The extent of this displacement also corresponds to a radius dimension of the discs 30 or of the cylinders 26.

Referring further to FIGS. 3, 4 and 5, the block-like body portions 70 and 72 of the connector 64 are integrally formed at body zones 90 and 92 thereof opposite the recessed zones 82 and 84, with rectangular protrusions 96 and 98. The latter are centered at the ends 102 and 104 of the body portions 70 and 72 which are opposite the curved surfaces or recesses 82 and 84. The protrusions 96 and 98 extend laterally a distance corresponding to the radial dimension of the discs 30 (or of the cylinders 26), and have a vertical expanse or height corresponding to the axial dimension or height of the cylinder elements 26. In the structure and arrangement described, each protrusion 96 and 98 is sandwiched and closely embraced at its upper and lower surfaces 108 and 110 and 112 and 114 between upper and lower discs 30, and abuts a cylinder element 26 of the band 60 laterally (FIG. 4). The structure described is further illustrated in the cross-sectional view depicted in FIG. 5.

Figure 9:
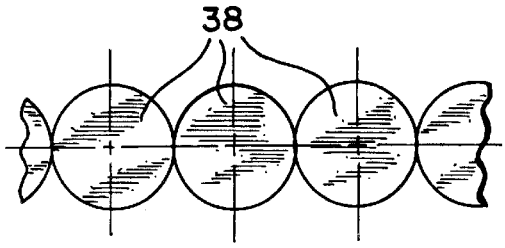
FIG. 9 is a top view of the arrangement of cylinder and disc components of the band of the invention shown in FIG. 8.

FIGS. 6 and 7 illustrate, in a front elevational view and in a top view, respectively, physical positioning and axial orientation of the cylinders 26 and the upper and lower discs 38 and 40 (or discs 30) of the embodiments of the invention shown in FIGS. 1 through 5. Fragmentary front elevational and top views provide, respectively, in FIGS. 8 and 9, views of the physical arrangement in an alternative embodiment of the invention in which the cylinder elements 26 together with the sandwiching upper and lower discs 38 and 40 (or discs 30) are all arranged in a coaxial mode.

What is claimed is:

1. An articulated band comprising a plurality of discrete metallic bodies; a majority of said bodies having at least one curved surface, and a longitudinal axis and opposed magnetic poles, said bodies being disposed in an uninterrupted lineal array, with each one of said bodies being in abutment against an adjacent one of said bodies of said articulated band to provide a stable mechanical structure in which the magnetic forces present in and established and operating through line and surface contactbetween said bodies constitute means for effecting and maintaining positive contact and strong separation-resisting stable magnetic joinder of each said bodies of said band to each one of said bodies disposed in a lineal physical abutment thereagainst, said bodies including bodies in lineal tangential contact contact along respective lineal expanses thereof, with respective opposed said poles of said bodies being separable yet firmly bonded to adhere physically to one another through magnetic forces acting therebetween, and each of said bodies having at least two faces, and said band including bodies composed of magnetic material exclusive of decorative and protective coatings.

2. An articulated band as set forth in claim 1 wherein said bodies are cylinders each magnetized in a direction at right angles to said longitudinal axis thereof.

3. An articulated band as set forth in claim 1 wherein said bodies include discs magnetized in a radial direction thereof.

4. An articulated band as set forth in claim 1 wherein said bodies include cylinders and discs having substantially corresponding diameters.

5. An articulated band as set forth in claim 4 wherein said discs are disposed at end faces of said cylinders coaxially therewith and in contacting abutment thereagainst to bond magnetically therewith.

6. An articulated band as set forth in claim 4 wherein said discs are disposed adjacent but offset axially from centers of end faces of said cylinders and in substantially coaxial correspondence with lines defined by abutting tangential lineal contact zones of contiguous cylinders of said band with one another.

7. An articulated band as set forth in claim 1 wherein said band is curved upon itself, and wherein opposite ends of said band are joined one to the other to establish said band as an endless looped structure.

8. An articulated band as set forth in claim 7 wherein said looped structure defines an uninterrupted, continuous, repetitive and endless pattern.

9. An articulated band as set forth in claim 1 characterized in that said band includes components which are entirely magnetic, and said band being devoid of pins and other mechanical devices for physically connecting adjacent segmental sectors of said band to one another.

10. An articulated band as set forth in claim 1 characterized by a high degree of flexibility in a plane defined by a linear array of said cylindrical bodies including cylindrical bodies and discs bonded thereto.

11. An articulated band as set forth in claim 10 wherein said band includes cylindrical bodies and discs, and wherein each said connector means includes a block-like body, each said block-like body of said connector means having a top-to-bottom expanse for accommodating a height dimension of said band, and each said body of said connector having a body thickness corresponding to a diameter of said cylindrical bodies of said band, said body of said connector means including at a first end thereof an endwise projecting protrusion having a width dimension reduced as compared with said body of said connector means, said protrusion having a lateral width dimension corresponding to a height dimension of said cylindrical bodies of said band and to spacing between opposed said discs of said band for facilitating entry of said protrusion between a pair of said discs at an end of said band, and for securement in place through magnetic forces acting between said discs, said cylinders, and said protrusions of said fastener, said fastener body being formed at an end thereof with inwardly-directed, outwardly-opening recess means for receiving therewithin to project endwise therefrom a disc corresponding to a disc of said band, said recess means having a depth dimension no greater than a radial dimension of said discs of said band, whereby said disc seats lengthwise within to bridge between said bodies of said connector means.

12. An articulated band as set forth in claim 1 and further comprising connector means disposed at opposed ends of said band and magnetically-bonded thereto for releasably intercoupling said ends of said band to one another to form a closed loop.

* * * * *